United States Patent [19]

Weingartner

[11] Patent Number: 4,647,127

[45] Date of Patent: Mar. 3, 1987

[54] ELECTRICAL CONNECTOR ASSEMBLY

[75] Inventor: Bernhard Weingartner, Feldkirch, Austria

[73] Assignee: Neutrik Aktiengesellschaft, Schaan, Liechtenstein

[21] Appl. No.: 801,381

[22] Filed: Nov. 22, 1985

Related U.S. Application Data

[63] Continuation of Ser. No. 500,209, Jun. 2, 1983, abandoned.

[30] Foreign Application Priority Data

Jun. 8, 1982 [AT] Austria ..... 2233/82

[51] Int. Cl.[4] ..... H01R 25/00

[52] U.S. Cl. ..... 339/48; 339/49 R; 339/59 M; 339/103 B

[58] Field of Search ..... 339/49 R, 49 B, 61 R, 339/61 M, 48, 59 R, 59 M, 76, 103 B

[56] References Cited

U.S. PATENT DOCUMENTS

| | | | |
|---|---|---|---|
| 2,219,940 | 10/1940 | Ritz-Woller | 339/103 B |
| 3,533,046 | 10/1970 | Barning | 339/48 |
| 3,631,375 | 12/1971 | Bridle | 339/59 M |
| 3,840,839 | 10/1974 | Smaczny et al. | 339/49 R |
| 4,455,056 | 6/1984 | Herrmann, Jr. et al. | 339/49 R |
| 4,531,796 | 7/1985 | Gansert et al. | 339/61 M |

FOREIGN PATENT DOCUMENTS

| | | | |
|---|---|---|---|
| 1465831 | 4/1969 | Fed. Rep. of Germany | 339/103 B |
| 48-33387 | 5/1973 | Japan . | |
| 767307 | 6/1954 | United Kingdom . | |

*Primary Examiner*—Gil Weidenfeld
*Assistant Examiner*—Paula A. Austin
*Attorney, Agent, or Firm*—Toren, McGeady and Goldberg

[57] ABSTRACT

A pair of complementary electrical connector members adapted to be electrically engaged with each other are formed with a housing having a contact element carrier located therein with a clamping sleeve within the housing having one end in abutting engagement with an end of the contact element carrier. The opposite end of the clamping sleeve extends axially beyond the housing and is formed with a tapered configuration about which there is engaged a clamping ring which is threadedly tightened about the housing to bring the clamping sleeve into engagement with the contact element carrier. The contact element carrier in each connector member is formed with elongated contact elements thereon which extend axially of the assembly and which have connector ends adapted to have electrical wires extending through the clamping sleeve connected thereto.

4 Claims, 9 Drawing Figures

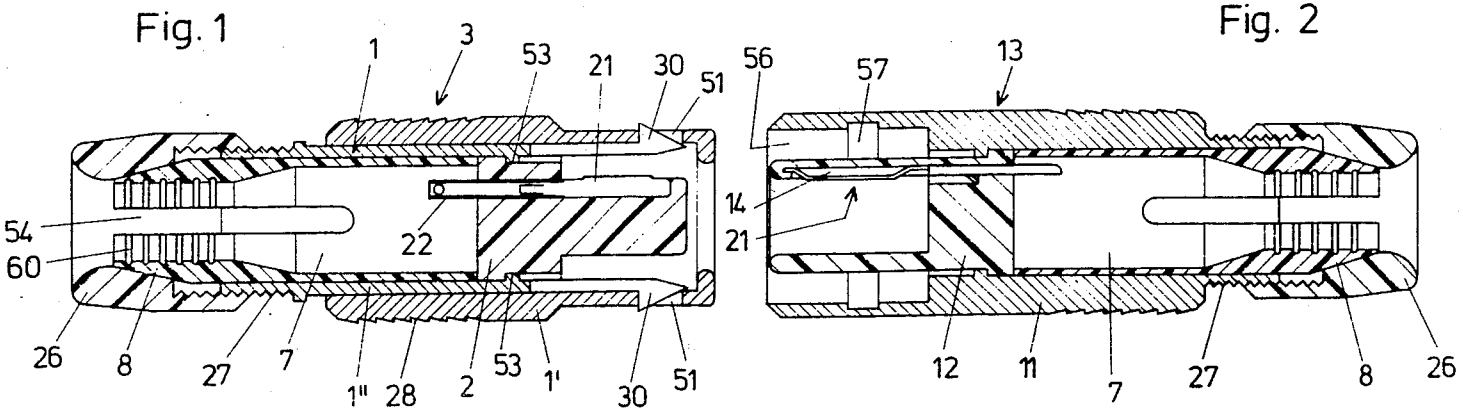
Fig. 2
Fig. 1
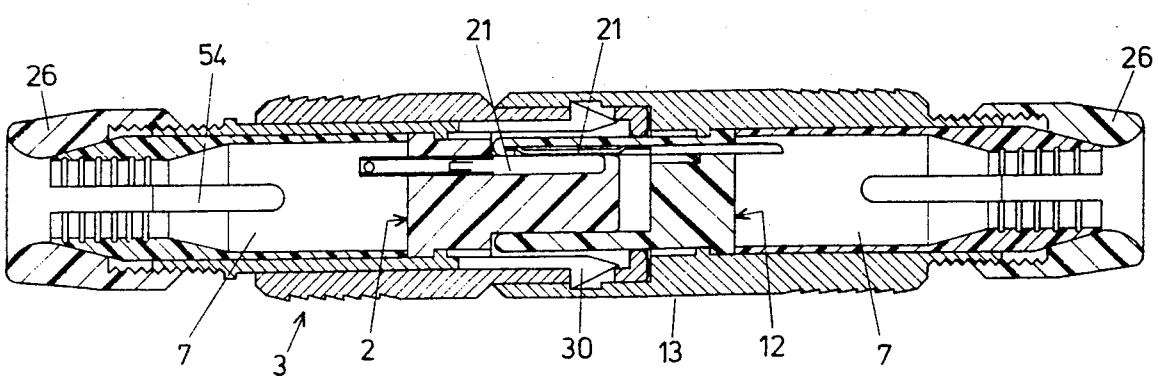
Fig. 3

ELECTRICAL CONNECTOR ASSEMBLY

This is a continuation of application Ser. No. 500,209 filed June 2, 1983 now abandoned.

The present invention relates generally to electrical connector devices and more particularly to an electrical connector or plug having a housing and a contact element carrier received within the housing with elongated contact elements mounted on the contact element carrier, the contact element carrier being formed from electrically insulating material with electrical connecting wires extending through a clamping sleeve formed within the housing.

Modern electrical connector and contact systems must generally be suitable for industrial large-scale use in automatic assembly machines and also for manual assembly. A connector of this type should be formed with as few component parts as possible, the component parts possibly serving to effect various functions and also being interchangeable.

The present invention is directed toward an assembly of the type described which will give rise to various advantageous features relating to ease of assembly in use and economy of manufacture.

SUMMARY OF THE INVENTION

Briefly, the present invention may be described as an electrical connector assembly comprising housing means which define a forward end and a rearward end of said assembly, electrically insulating contact element carrier means mounted within the housing means with a first end facing toward said rearward end and with a second end facing toward said forward end, elongated contact elements mounted on said carrier means having a connection end arranged toward said rearward end and a contact end arranged toward said forward end, said connection end being adapted to have electrical wire means connected thereto, said contact end adapted to be placed in electrically conductive engagement with the contact end of a complementary contact element, a clamping sleeve within said housing having a forward end in abutting engagement with said first end of said carrier means and a rearward end having a tapered configuration extending axially beyond said housing means, thread means at said rearward end of said housing means and a threaded clamping ring arranged around said tapered rearward end of said clamping sleeve in threaded engagement with said thread means to urge said forward end of said clamping sleeve against said first end of said carrier means.

Thus, in accordance with the present invention, as a result of the operation of the threaded clamping means and of the tapered end of the clamping sleeve, the innermost or forward end of the clamping sleeve will be brought into contact with the rear end of the contact element carrier where the projecting connection ends of the contact elements are arranged and the clamping ring is arranged to contact the tapered end of the clamping sleeve which is preferably arranged with a conical configuration, the clamping ring having an inner configuration which corresponds with the configuration of the tapered end of the clamping sleeve. By screwing the clamping ring onto the thread means provided at the housing means, the clamping sleeve is thus fixed in position and is pressed against the carrier means.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 1 is a sectional view of a connector member forming one part of the connector assembly of the invention;

FIG. 2 is a sectional view of a complementary connector member forming the other part of the connector assembly of the invention;

FIG. 3 is a sectional view showing the connector members of FIGS. 1 and 2 in their interconnected position;

DETAILED DESCRIPTION OF THE PREFERRED EMBODIMENTS

Figures 4, 5:
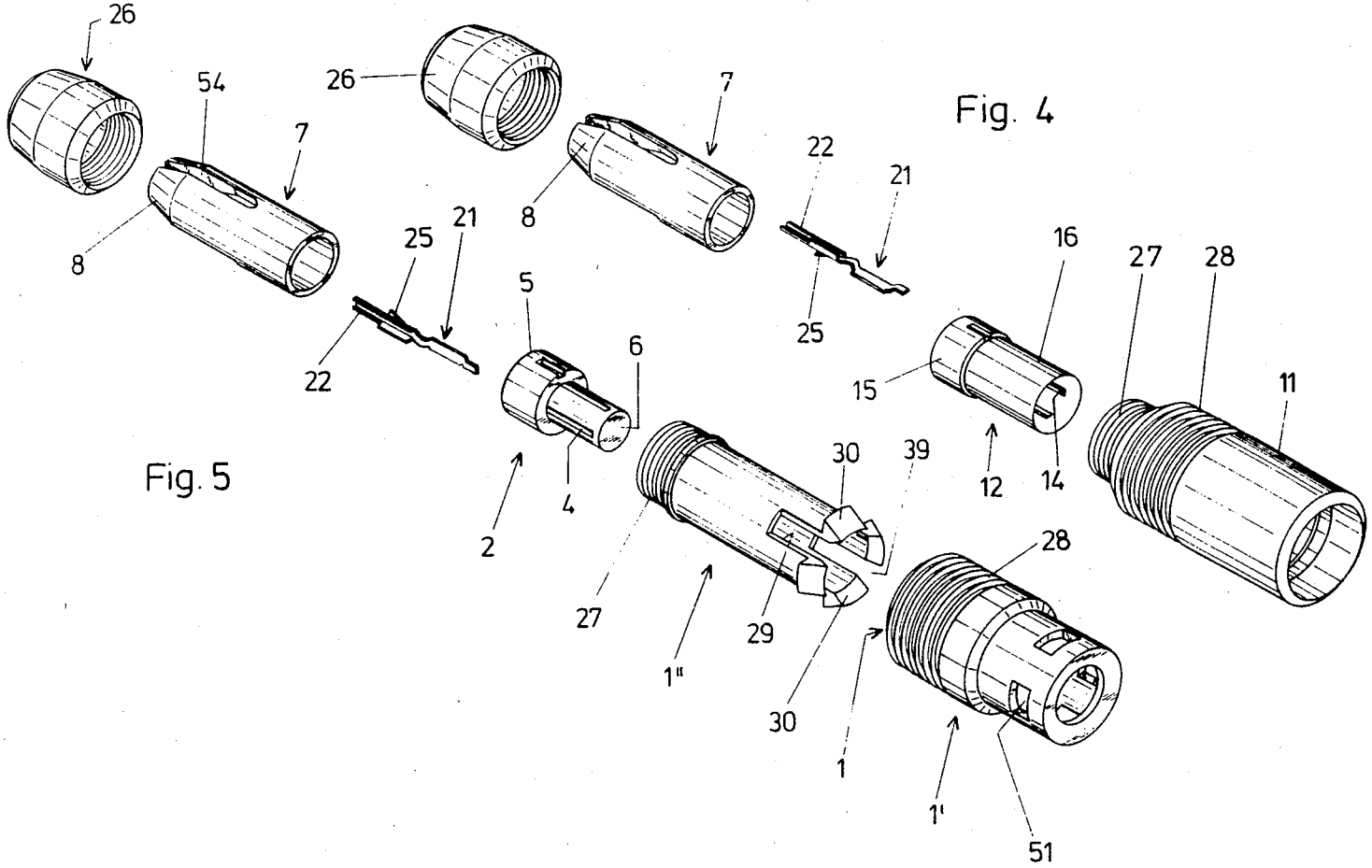
FIGS. 4 and 5 are perspective exploded views showing, respectively, the individual parts of the connector member of FIG. 2 and of FIG. 1.

Referring now to the drawings and particularly to FIGS. 1, 2, and 3, the connector assembly of the present invention is basically comprised of a pair of connector members 3 and 13 which are shown separately and disconnected in FIGS. 1 and 2 and which are shown in their interconnected position in FIG. 3. Each of the connector members 3 and 13 is formed with a plurality of contact elements 21 which are generally similar in configuration and which are brought into electrically conductive engagement when the connector members 3 and 13 are plugged together as shown in FIG. 3.

The connector member 3 comprises a connector housing which is constructed in two parts consisting of a first housing sleeve 1'' having a thread 27 at one end. The housing 1 defines a rear side shown to the left in FIG. 1 and a front side or forward side shown to the right in FIG. 1 and the forward side of the sleeve 1'' is divided into four detent members 30 which are located between interposed elongated slots 29 which extend parallel to the axis of the connector assembly, as best seen in FIG. 5.

The housing 1 also consists of a sleeve 1' formed with ribbing 28 on its outer surface for enhancing gripping of the housing, the sleeve 1' being adapted for sliding movement over and along the sleeve 1''.

The sleeve 1' has formed at the forward end thereof a plurality of notches 51 adapted to receive therein the detents 30.

The two sleeves 1' and 1'' are axially displaceable relative to each other. When the sleeve 1' is moved rearwardly or to the left as seen in FIG. 1 relative to the sleeve 1'', the sides of the notches 51 will slide along the tapered faces of the detents 30 thereby moving the detents 30 radially inwardly to effect a mode of operation to be described more fully hereinafter.

The connector member 3 also includes a contact element carrier 2 which is composed of an electrically insulating material and which is inserted in the connector housing 1. The structural details of the contact element carrier 2 are shown on an enlarged scale in FIG.

6. The carrier 2 is formed in one piece with two cylindrical sections 5 and 6, the section 5 having a larger diameter than the section 6. The cylindrical section 5 contacts the inside of the housing 1 and is formed with grooves 52 at its border wherein there engage noses or spring members 53 formed on the inside of the sleeve 1″ in order to position the sleeve 1″ relative to the carrier member 2.

The connector member 3 also includes a clamping sleeve 7 which is inserted into the housing 1 within the sleeve 1″. The clamping sleeve 7 is made from plastic material and is formed with axial slots 54. The sleeve 7 includes a rearward end 8 which extends axially beyond the housing 1 and which is formed with a tapered configuration sloping to a reduced diameter at its rearward end. The inside of the clamping sleeve 7 is formed with channels or grooves 60 at the rear end 8 and the length of the sleeve 7 is dimensioned in such a manner that it axially projects beyond the housing 1 when the connector member is correctly assembled with the forward side or rightmost end of the sleeve 7 being in contact with the rear end of the contact element carrier 2.

Contact elements 21 are mounted on the contact carrier 2 with the elements 21 having connection ends 22 which project toward the rear of the assembly. A clamping ring 26 is screwed onto the threads 27 formed at the rear end of the housing 1 with the clamping ring 26 being arranged in engagement about the tapered or conical end 8 of the clamping sleeve 7. The clamping ring 26 is formed with a conically shaped interior which generally corresponds with the tapered outer surface of the end 8 and as the clamping ring 26 is screwed onto the threads 27, the ring 26 presses the clamping sleeve 7 against the rear end of the contact element carrier 2 thereby fixing the carrier 2 in its indicated position so that it will be correctly located.

The clamping sleeve 7 is adapted to have electrical wire means introduced through the rear end thereof and thus serves to permit electrical wires to be connected to the connection end 22 of the contact element 21 with the forward end of the sleeve 7 operating to ensure correct positioning of the contact element carrier 2.

Figure 6:
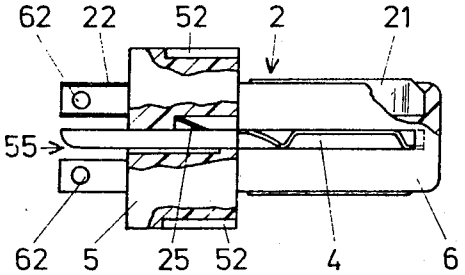
FIGS. 6 and 7 are sectional views showing contact element carriers forming parts of the connector members of FIGS. 1 and 2 respectively.

The contact element carrier 2, shown on an enlarged scale in FIG. 6, is formed with axially extending grooves 4 which are located at the circumference of the cylindrical section 6, and the cylindrical section 5 is formed with openings through which the contact elements 21 are inserted from the rear end of the assembly as indicated by the arrow 55, with spring clips 25 formed in the contact elements 21 operating to affix the contact elements in their desired position in the carrier 2.

The connection ends 22 of the contact elements 21 are formed with soldering eyes 62. However, it will be understood that other means for attaching electrical connector wires may be utilized, and such other means may include crimping, wire wrapping, insulation displacement, or the like. To insert the contact elements 21 into the contact element carrier 2, it is preferred that this be accomplished after a wire end has been connected with the connection end 22 of the element 21. Then the element 21 may be inserted in the direction of arrow 55, that is, from the rear of the assembly, into a recess provided for this purpose in the cylindrical section 5 until the front end of the contact element engages the front side of the groove 4 and until the spring clip 25 catches in a recess in the cylindrical section 5 provided for this purpose. The contact element 21 will thus be affixed in the contact element carrier 2.

The complementary or second connector member 13 is also formed with a contact element carrier 12 mounted therein similar to contact elements, 21 which are inserted in the carrier 12 in a manner generally identical described in connection with the carrier 2.

Figure 7:
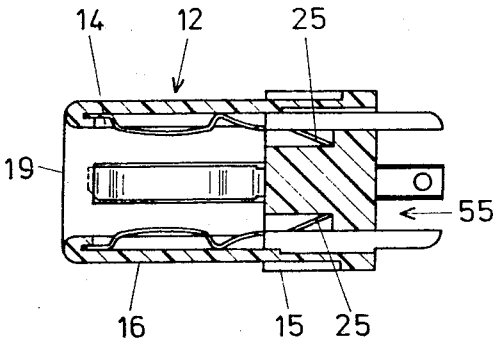

The contact element carrier 12 is supported and fixed in a complementary sleeve 11 in a manner similar to that described in connection with the device of FIG. 1, the sleeve 11 forming the housing means for the connector member 13. The contact element carrier 12 is constructed in the form of a hollow cylinder having a cylindrical section 15 with a larger diameter and a cylindrical section 16 with a smaller diameter, as best seen in FIGS. 4 and 7.

The member 13 is provided with a clamping sleeve 7 which contacts the contact element carrier 12 from the rear or rightmost side thereof as seen in FIG. 2. The sleeve 7 thus is pressed against the rightmost or rearward end of the carrier 12 by operation of a clamping ring 26 which is generally similar to the ring 26 shown on the member 3 and which is also screwed onto a thread 27 formed on the housing sleeve 11. The clamping sleeve 7 of the connector member 13 is constructed generally in the same manner as the sleeve 7 shown in FIG. 1 as part of the connector member 3.

The inner side 56 of the housing sleeve 11 has an annular groove 57 formed therein toward the forward end of the sleeve 11. The cylindrical section 16 of the contact element carrier 12 is constructed as a hollow cylinder and contact elements 21 contact the inner wall of this hollow cylinder and are inserted in the carrier 12 from the rear end thereof and are held in fixed engagement therein. Additionally, the contact elements 21 utilized in the complementary connector member 13 are identical to those described in connection with the connector member 3. The carrier 12 is formed with elongated recesses or grooves 14 having an undercut forward end formed on the inside of the hollow cylinder 16. The forward end of the inserted contact elements 21 project into this undercut formation and are thereby supported in place.

In FIG. 3, the connector members 3 and 13 are shown connected together. The detents 30 are engaged within the grooves 57 in the housing sleeve 11. In order to detach the interconnected members 3 and 13, the sleeve 1′ is pulled toward the left, as shown in FIG. 3, and as a result the sides of the notches 51 engage against the slanted faces of the detents 30 thereby causing the detents 30 to be moved radially inwardly. As a result of this inward displacement of the detents 30, the locking engagement of the detents 30 within the grooves 57 is released and the connector members 3 and 13 can therefore be pulled apart and separated into the positions depicted in FIGS. 1 and 2.

For the sake of clarity, the assemblies shown herein are depicted with only one contact element 21 shown in each of the connector members of FIGS. 1 and 2. However, as shown in FIGS. 6 and 7, it should be understood that it would be possible to insert a plurality of contact elements 21 into the contact element carriers 2 and 12, with the contact elements 21 being distributed at predetermined angular locations on the circumference of the respective contact element carrier. Of course, it will be understood that the housing means of the invention may be formed so as to ensure that the relative radial or angular positioning of the connector members 3 and 13 is maintained in a predetermined relationship.

The carriers 2 and 12 are constructed as hollow cylinders, but it is possible within the scope of the invention to provide other geometric configurations for the contact element carriers, and rectangular or polygonal cross-sectional shapes may be provided.

Figure 8:
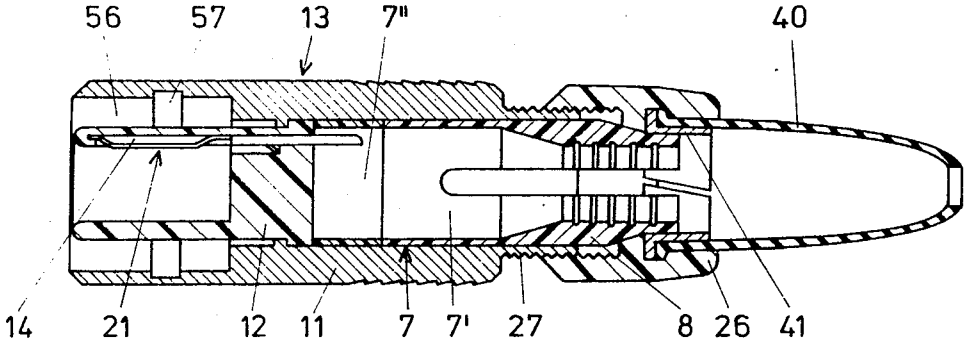
FIGS. 8 and 9 are sectional views each showing different embodiments of the invention.

A further embodiment of the invention is illustrated in FIG. 8 wherein the clamping sleeve 7 is constructed in two parts axially juxtaposed relative to each other. As seen in FIG. 8, the clamping sleeve includes a clamping element 7' and a distance ring 7''. The distance ring 7'' may be provided in a desired length in order thereby to make it possible to adapt the clamping sleeve 7 to different connector housing lengths merely by insertion of the correctly dimensioned distance ring 7''.

A further modification shown in the example of FIG. 8 involves equipping the clamping ring 26 with a bush 40. The bush 40 is composed of a material which is softer and more flexible than the clamping ring 26 and the bush 40 is fixed at the ring 26 by means of a retaining ring 41, as shown in FIG. 8.

Figure 9:
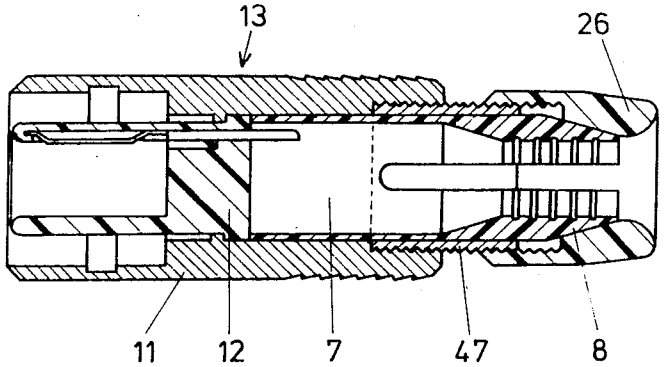

In each of the embodiments described in connection with FIGS. 1–7 and 8, the clamping ring 26 is, in each instance, screwed onto an outer male thread 27 at the end of the connector housing. However, in accordance with an embodiment shown in FIG. 9, it is also possible to arrange the housing sleeve 11 with a female thread and to provide a threaded sleeve 47 arranged in engagement between the housing sleeve 11 and the clamping ring 26. The clamping ring 26 is then screwed onto the threaded intermediate sleeve 47, as shown in FIG. 9. Of course, it should be understood that the threaded sleeve 47 and the clamping ring 26 shown in FIG. 9 could be constructed in one piece.

In all of the embodiments described herein, the clamping sleeve 7 is structured substantially in the same manner with a conical extension at one end with which the clamping ring 26 cooperates. It is possible within the scope of the invention to permit the clamping sleeve 7 to extend cylindrically beyond the end of the housing and to permit this cylindrically terminating part to cooperate with the conical tapered portion of the clamping ring 26.

The individual structural component parts of the connector members 3 and 13 are dimensioned in such a way that they are interchangeable. Thus, it will be easily possible to remove the contact element carrier 12 from the connector member 13 and insert it into the housing 1 of the connector member 3 and to proceed in a corresponding manner with the contact element carrier 2 of the connector member 3. Also, the contact element 21 for each of the connector members 3, 13 are structured in an identical manner and the same applies thereto. Of course, the clamping sleeves 7 and the coupling or clamping rings 26 are also identical in construction and therefore interchangeable.

If the contact element carriers are structured with a rectangular or polygonal form, the contact elements may then be supported on flat or level surfaces instead of cylindrical surfaces. Of course, the housing parts and the clamping sleeves could then be correspondingly configured.

In each of the examples shown, the end of the clamping sleeve 7 projects beyond the connector housing. It is also possible for the clamping sleeve 7 to be made of such a length that it does not project relative to the connector housing, but is flush therewith or is even somewhat offset to the rear relative to the housing end. In this case, the clamping ring may be equipped with an inwardly projecting conical extension which may cooperate with the tapered or conical end of the clamping sleeve when the clamping ring is screwed onto the housing end.

Of course, it will be seen that, as shown in FIGS. 1, 2, and 3, the clamping members 3 and 13 are formed, respectively, as a male connector and a female connector.

While specific embodiments of the invention have been shown and described in detail to illustrate the application of the inventive principles, it will be understood that the invention may be embodied otherwise without departing from such principles.

What is claimed is:

1. An electrical connector assembly formed of a first and a second connector member adapted to be engaged with each other, each of said connector members comprising:

housing means defining a forward end and a rearward end of said assembly and having inwardly projecting flange means with at least the housing means of said first connector member being formed to include first and second housing members;

an electrically insulating contact element carrier member mounted within said housing means with a first end facing toward said rearward end and a second end facing toward said forward end; said housing means being constructed to enable insertion and removal of said contact element carrier member from said rearward end;

shoulder means on said contact element carrier member in abutting engagement with said flange means for determining the position of said contact element carrier member in said housing means;

elongated contact elements mounted on said carrier member having a connection end arranged toward said rearward end and a contact end arranged toward said forward end, said connection end being adapted to have electrical wire means connected thereto, said contact end of each of said contact elements in one of said connector members being adapted to be placed in electrically conductive engagement with the contact end of a complementary contact element in the other of said connector members;

a clamping sleeve within said housing means having a forward end in abutting engagement with said first end of said carrier member and a rearward end having a tapered configuration extending axially outwardly beyond said rearward end of said housing means;

male thread means at said rearward end of said housing means; and a threaded clamping ring arranged to engage around said tapered rearward end of said clamping sleeve in threaded engagement with said male thread means to urge said forward end of said clamping sleeve in abutting engagement against said first end of said carrier member to hold said carrier member in clamped engagement between said flange means and said forward end of said clamping sleeve;

detent means mounted in said first housing member of said first connector member;

groove means formed in said second connector member adapted to be engaged by said detent means to lock said first and second connector members together;

said first and said second housing members being axially slidable relative to each other, with said second housing member engaging said detent means to disconnect said locking engagement between said first and second connector members;

said first and second connector members being readily assembled and disassembled without the use of tools merely by threadedly engageing or disengaging said clamping ring onto or from said clamping sleeve to allow said carrier elements together with said contact elements mounted thereon to be slidably inserted into or removed from said housing means.

2. An assembly according to claim 1 wherein said clamping ring is equipped with a cable bush.

3. An assembly according to claim 1 further comprising a threaded sleeve screwed into said housing means, said threaded sleeve being adapted to receive said clamping ring and having a section projecting forwardly relative to said housing means.

4. An assembly according to claim 3 wherein said clamping ring is equipped with a cable bush and wherein said clamping ring and said cable bush are manufactured from different materials.

* * * * *